United States Patent [19]

Gach

[11] 3,946,889

[45] Mar. 30, 1976

[54] TAMPER INDICATING CHILD RESISTANT CLOSURE

[75] Inventor: Peter P. Gach, Evansville, Ind.

[73] Assignee: Sunbeam Plastics Corporation, Evansville, Ind.

[22] Filed: Mar. 5, 1975

[21] Appl. No.: 555,684

[52] U.S. Cl. ..... 215/219; 215/7; 215/253

[51] Int. Cl.[2]. B65D 85/56; A61J 1/00; B65D 55/02

[58] Field of Search ..... 215/9, 7, 217, 219, 220, 215/253, 254

[56] References Cited

UNITED STATES PATENTS

| | | | |
|---|---|---|---|
| 3,679,085 | 7/1972 | Gach | 215/220 |
| 3,710,970 | 1/1973 | Elfine | 215/219 |
| 3,837,518 | 9/1974 | Gach | 215/7 |

*Primary Examiner*—George T. Hall

*Attorney, Agent, or Firm*—Henry K. Leonard

[57] ABSTRACT

A tamperproof child resistant closure for a medicine bottle or the like. The closure has an inner threaded cap and an outer driver nested over the cap. There is a first co-operating, one-way clutch means on the driver and cap for screwing the cap onto the bottle. There is a second one-way, co-operating clutch means comprising an abutment on the outer wall of the cap skirt and an inwardly movable segment of the driver skirt. There is a removable sector portion of the driver top that is frangibly connected to the upper end of the segment and to the driver top which initially prevents inward movement of the segment for engaging the second clutch means.

11 Claims, 11 Drawing Figures

TAMPER INDICATING CHILD RESISTANT CLOSURE

BACKGROUND OF THE INVENTION

In my earlier Pat. Nos. 3,679,085 of July 25, 1972, and 3,722,727 of Mar. 27, 1973, I disclosed a so-called "Child-Proof" closure or cap for medicine bottles or the like having an inner threaded cap which screws onto the neck of the bottle and an outer over-cap or driver. The inner cap and driver were nested together one over the other. In the disclosure of both of the above patents the cap and the driver have one-way driving means for screwing the cap onto the bottle neck and they have second co-operating driving means for unscrewing the cap off of the neck of the bottle. The second one-way engagable driving means is made operable only when a portion of the wall of the driver is inwardly displaced to engage a co-operating abutment or recess on the outer wall of the inner cap. The closures are thus relatively child-proof because a small child cannot comprehend the requirement for engaging the second driving means and, if the child rotates the outer cap or driver in an unscrewing direction, it merely rotates relative to the inner cap without unscrewing the inner cap.

The closures of the two above patents are entirely satisfactory from the standpoint of rendering the closures child-resistant or child-proof, i.e., being significantly difficult to be opened by a child of the age of, say, six years or less. Equally important, closures embodying the two above listed patents readily can be opened by older children or by adults.

However, there is an additional problem with respect to prepackaged medicines such as aspirin, cold tablets and the like, even when they are packaged in bottles upon which the closures of the two above patents have been placed. There is no way of preventing an adult or an older child from opening the package while it is on the shelf in a large drugstore or super market, either to sample the contents or to switch the cap of this type upon which a certain price has been stamped for a cap of another product upon which a lower price has been stamped. Cap switching in large stores, where the clerks cannot maintain observation of all of the customers, has become a serious problem because the check-out operators are unable to check the label on the bottle against the price on the cap to make sure that the caps have not been switched.

It is, therefore, the principal object of the instant invention to provide a child-resistant cap of the type disclosed in the above mentioned patents but also comprising a tamper indicating feature making it readily apparent to a check-out clerk that the cap has been tampered with or switched by the customer.

A more specific object of the instant invention is to provide a tamper-indicating, child-resistant cap for a medicine bottle, or the like, having a threaded neck in which the cap comprises two nested elements with co-operating one-way drive means requiring that a portion of the outer element or driver be displaced inwardly to engage the inner element or bottle cap in order to unscrew the cap and initially having means for preventing that engage ment without removal of a portion of the outer driver to permit the engagement of the one way drive means, the removal of that outer portion being readily visible to a clerk at a check-out counter of a market or pharmacy.

DESCRIPTION OF PREFERRED EMBODIMENTS

Figure 1:
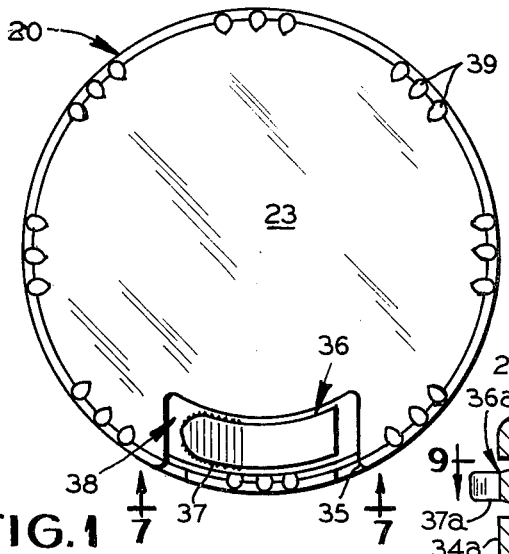
FIG. 1 is a top plan view of a closure embodying the invention.
Figure 4:
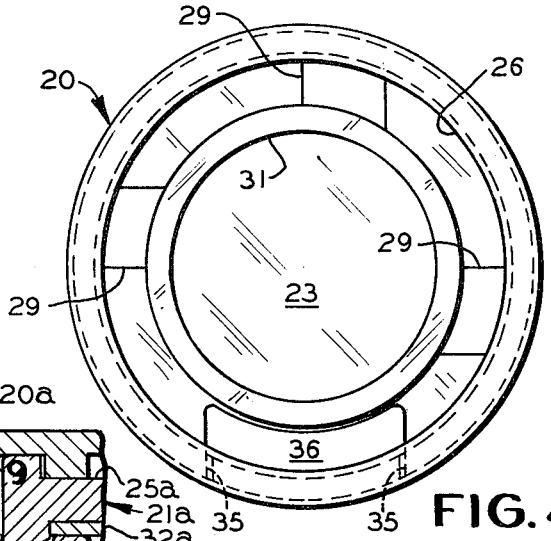
FIG. 4 is a bottom plan view looking into the interior of the over-cap of this embodiment of the invention, shown on the same scale as FIGS. 1 and 2.

The embodiment of the invention illustrated in FIGS. 1–7, inclusive, consists of an over cap or driver 20 and an inner or bottle cap 21. The driver 20 has an annular skirt 22 and a closed top 23. The inner cap 21 has a similar annular skirt 24 and a closed top 25.

Figure 2:
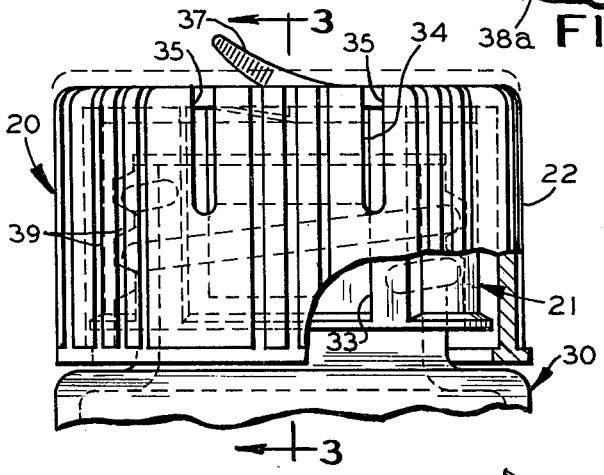
FIG. 2 is a side view in elevation of the embodiment of the invention illustrated in FIG. 1, with parts broken away and showing a bottle fragmentarily.
Figure 5:
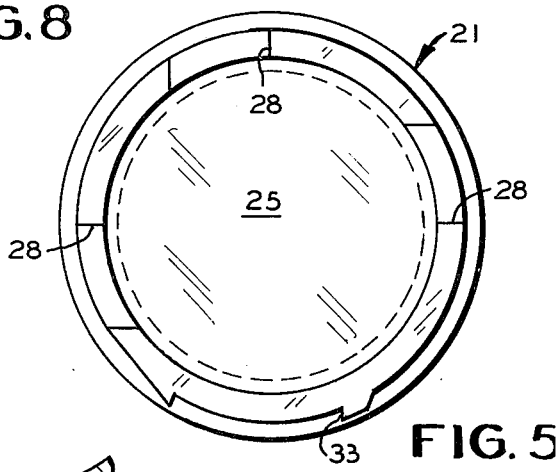
FIG. 5 is a top plan view of the inner bottle cap of this embodiment of the invention.
Figure 3:
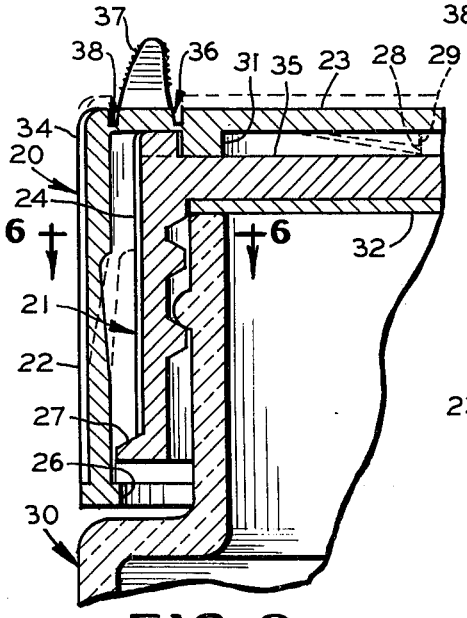
FIG. 3 is a fragmentary, vertical sectional view taken along the line 3—3 of FIG. 2 and illustrated on an enlarged scale.

The outside diameter of the inner cap 21 and the outside diameter and axial length of its skirt 24 are less than the inside diameter and axial length of the driver skirt 22. The two elements of the invention, viz., the driver 20 and the cap 21 are thus designed and adapted to be telescoped and a lip 26 on the driver skirt 22 has an inside diameter which is less than the outside diameter of an outwardly directed rim 27 at the lower margin of the cap skirt 24. Inter-engagement between the lip 26 on the driver skirt and the rim 27 on the cap skirt retains the driver 20 and cap 21 in their telescoped position as illustrated in FIGS. 2 and 3.

A closure according to the invention has first co-operating one-way drive means consisting of inclined ratchet dogs 28 on the underside of the cap top 25 and oppositely directed ratchet dogs 29 on the underside of the driver top 23. The dogs 28 and 29 are illustrated as being located on these opposed closed tops of the driver 20 and cap 21, and also are so illustrated in the above mentioned patents. However, it will be readily apparent that they may also be located at the shoulders of the driver and cap 20 or 21 or even on their peripheral surfaces. The only requirement insofar as the instant invention is concerned, is that the dogs 28 and 29, or similar ratchet-like members, shall be engageable with each other for transmitting torque from the driver 20 to the cap 21 only when the driver 20 is rotated in a direction to screw the cap 21 onto the threaded neck of a bottle 30, fragmentarily illustrated in FIGS. 2 and 3. The co-operating dogs 28 and 29 extend around the opposed surfaces of the driver top 23 and cap top 25 in two annular series so that they readily overlap each other when the driver 20 is in its lower position as illustrated in FIG. 3. The underside of the driver top 23 (see FIG. 4) has a downwardly extending guide ring 31 of lesser diameter than the area of the dogs 28 and 29 to function as a guide for the rotation of the driver 20 relative to the cap 21 after they are assembled into the position illustrated in FIGS. 2 and 3.

Preferably, the cap 21 is molded, for example, from a relatively stiff resinous material such as medium impact polystyrene or even from metal so that it may be threaded down onto the neck of the bottle 30 sufficiently tightly to compress the marginal edges of a disc-like liner 32 against the lip of the neck of the bottle 30 in order to seal the bottle against the escape of liquids or to prevent the ingress of atmosphere if the bottle contents would be undesirably affected thereby.

Because the one-way drive means comprising the dogs 28 and 29 is effective for screwing the cap 21 onto the neck of the bottle 30, a closure embodying the invention may be placed on filled bottles by conventional capping machines and the cap 21 may be restored onto the neck of a bottle 30 after use simply by pressing downwardly on the driver 20 and rotating it in a conventional direction.

If a small child, or one unable to comprehend the method of opening the bottle, attempts to rotate the driver 20 in a counter clockwise direction (conventional threading) even by forcing it downwardly, the driver 20 will merely ratchet in that direction snapping up and down as the dogs 28 and 29 clear each other with the driver 20 being moved upwardly to the dotted line position indicated in FIGS. 2 and 3 while this attempt is being made. If the driver 20 is pulled upwardly and then rotated in a counterclockwise direction, the upward movement limited by the engagement of the lip 26 and rim 27 will disengage the dogs 28 and 29 from each other and the driver 20 will simply rotate freely relative to the cap 21.

A closure embodying the invention also has a second, engageable, co-operating one-way drive means functioning to unscrew the cap by transferring torque from the driver 20 to the cap 21. This second engageable one-way drive means comprises co-operating elements which consist of at least one abutment 33 formed on the outer surface of the cap skirt 24 and having a vertically extending face and at least one radially inwardly displacable element 34. The element 34 may be described as an annular sector portion of the driver skirt that, in this embodiment, is defined by two circumferentially spaced and axially extending slots 35 formed in the upper portion of the driver skirt 22. The element 34 is integral with the body of the driver skirt 22 at its lower end. In the initial construction of the driver 20, i.e., when it is to be first threaded onto the neck of a bottle by a manufacturer and before any effort has been made to open the bottle, the upper end of the element 34 is spaced outwardly lying in the same annular area as the remaining portion of the driver skirt 22. The upper end of the element 34 is connected in this embodiment of the invention to the driver top 23 by a removable sector-like spacer 36 having a manually graspable tab 37. The removable spacer 36 is integrally connected to the upper end of the sector-like portion of the element 34 by a thin frangible web 38 which extends all around the removable spacer 36 being connected at its inner side and at its ends by continuations of the web 38.

It is thus impossible for one seeking to open the bottle to inwardly move the element 34 in order to engage its edge with the abutment 33 until after the spacer 36 has been torn away.

As a result of the presence of the removable spacer 36, it is readily apparent to a check-out clerk in a market whether or not anyone has attempted to open the package either to remove its contents or to switch a cap of a less expensive product for the cap of the more expensive product which the person has picked from the shelf.

Figure 6:
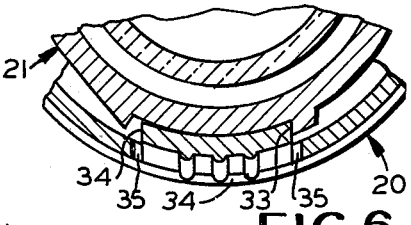
FIG. 6 is a fragmentary, horizontal, sectional view taken substantially along the line 6—6 of FIG. 3 but illustrating the co-operating one-way driving means by which the torque applied to the over-cap or driver is delivered to the inner bottle cap in order to remove the closure from the bottle.

After the removable element 34 has been torn away by rupturing the frangible web 38, an older child or an adult readily can open the package simply by pressing inwardly on the element 34 and rotating the driver 20 in a counter-clockwise direction until the element 34 snaps into position behind the abutment 33 as is illustrated in FIG. 6. Thereafter continued rotation of the driver 20 in a counter-clockwise direction delivers torque to the cap 21 so that it can be unscrewed and removed from the neck of the bottle 30.

FIGS. 8 AND 9

Figure 8:
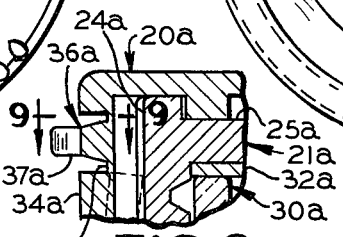
FIG. 8 is a fragmentary, vertical sectional view similar to the upper left portion of FIG. 3 but illustrating a second embodiment of the invention.
Figure 9:
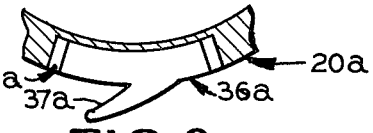
FIG. 9 is a fragmentary, horizontal sectional view taken along the line 9—9 of FIG. 8

A second embodiment of the invention is illustrated in FIGS. 8 and 9. Because most of the component parts of the driver 20 and cap 21 are identical with those previously described with respect to FIGS. 1–7, inclusive, like parts in FIGS. 8 and 9 will be similarly numbered without further description. In FIGS. 8 and 9 a neck of a bottle indicated by the reference number 30*a* is fragmentarily shown as is a portion of a liner 32*a* which is tightened against the lip of the neck of the bottle 30*a* by an inner cap 21*a*. The cap 21*a*, like that of the earlier embodiment, has a top 25*a* and a skirt 24*a*. The closure also comprises an over cap or driver 20*a* and the driver 20*a* and cap 21*a* are provided with the one-way driving means comprising the dogs 28 and 29 which are not illustrated in FIGS. 8 and 9.

In this second embodiment of the invention, however, the location of a spacer 36*a* is in the upper portion of the skirt 22*a* of the driver 20*a* rather than being at the margin of the top of the driver 20*a*. As in the earlier embodiment the spacer 36*a* constitutes an annular sector-like portion of the driver skirt, and has, in this case, a radially outwardly extending finger tab 37*a*. The tab 37*a* and the entire spacer 36*a* are connected along their upper and lower surfaces and at their ends by a thin frangible web 38*a* which is comparable in function to the web 38 previously described. Again, it is impossible to deflect the upper end of the element 34*a* inwardly in order to engage with the abutment 33 on the cap skirt 24 until after removal of the spacer 36.

FIGS. 10 AND 11

Figure 10:
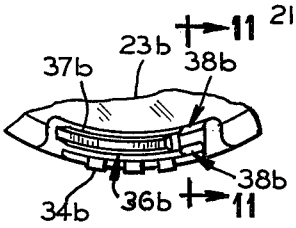
FIG. 10 is a fragmentary plan view of the tamper preventing spacer according to a third embodiment of the invention.
Figure 11:
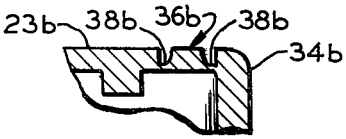
FIG. 11 is a fragmentary, vertical sectional view taken along the line 11—11 of FIG. 10 and shown on a slightly enlarged scale.
Figure 7:
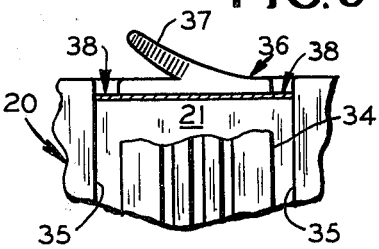
FIG. 7 is a fragmentary view in side elevation, with parts broken away, taken substantially from the position indicated by the line 7—7 of FIG. 1.

A third embodiment of the invention is illustrated in FIGS. 10 and 11, where frangible web 38*b* is shown as extending only part of the way around a spacer 36*b* which also has a finger tab 37*b*. As in the other embodiments of the invention, the spacer 36*b* and the web 38*b* are integral with the driver 20, in this case a part of a driver top 23*b*. The spacer 36*b* prevents the one-way drive element 34*b* from being flexed inwardly until after the spacer 36*b* has been torn away.

It will be appreciated that the extent of the frangible webs 38, 38*a* or 38*b* around their respective spacers 36, 36*a* or 36*b* is selected to determine the force necessary to remove the particular spacer so as to enable the closure to be unscrewed.

In all embodiments of the invention the driver 20 preferably is fabricated from a comparatively more resilient material than that from which the cap 21 is fabricated, for example, the driver may be molded from polypropylene.

Preferably, the skirt of the driver 20 is provided with a plurality of vertical ribs 39 in order to facilitate grasping the driver 20 in the fingers of a person either wishing to restore the closure to the bottle or to unscrew the closure after the displaceable element 34 has been squeezed inwardly into engagement with the cap skirt abutment 33.

Having described my invention, I claim:

1. A tamper indicating, child-resistant closure for a medicine bottle or the like having a threaded neck, said closure consisting of:

a. an inner, cup-shaped cap having an annular skirt that is internally threaded to mate with the threaded neck of the bottle and a disc-like circular top, b. an outer cup-shaped driver having a disc-like top and an annular skirt having an inside diameter greater than the exterior diameter of said cap skirt, c. co-operating one-way drive means on adjacent parts of said cap and said driver engageable for screwing said cap onto the neck of the bottle, c. and second, engageable, co-operating one-way drive means for unscrewing said cap, said second drive means consisting of 1. at least one abutment on the outer surface of said cap skirt, 2. an annular sector-portion of said driver skirt that is defined by circumferentially spaced slots in said driver skirt which extend axially upwardly from a level below the top of said driver skirt; and 3. a removable sector-like spacer that is a part of said driver that is connected by frangible webs to the upper end of said annular skirt portion and to an adjacent portion of said driver.

2. A closure according to claim 1 in which the frangible webs extend around all sides of the removable spacer.

3. A closure according to claim 1 in which the frangible webs extend along at least a part of the inner and outer sides of the removable spacer.

4. A closure according to claim 1 in which the abutment is one side of an axially extending recess in the outer surface of the cap skirt.

5. A closure according to claim 1 in which the removable spacer has a radial thickness at least greater than the radial distance between the inner surface of the driver skirt and the radially outermost edge of the abutment.

6. A closure according to claim 1 and a manually graspable tab on the removable spacer.

7. A closure according to claim 1 in which the annular sector portion of the driver skirt is integral with the skirt at its lower end and its upper end is inwardly movable for engagement with the abutment after the removal of the removable spacer.

8. A closure according to claim 1 in which the removable spacer is a part of the top of the driver.

9. A closure according to claim 8 in which the removable spacer has an upwardly extending manually graspable tab.

10. A closure according to claim 1 in which the removable spacer is at the upper end of the annular sector portion of the driver skirt.

11. A closure according to claim 10 and a manually graspable tab on the removable spacer.

* * * * *